US006981659B1

(12) United States Patent
Hopkins

(10) Patent No.: US 6,981,659 B1
(45) Date of Patent: Jan. 3, 2006

(54) LIQUID MIST FIRE EXTINGUISHER

(76) Inventor: Gordon Duane Hopkins, c/o Terra Nova Marine Company Limited, 119 Clyde Avenue, Mount Pearl, Newfoundland & Labrador (CA) A1N 4R9

( * ) Notice: Subject to any disclaimer, the term of this patent is extended or adjusted under 35 U.S.C. 154(b) by 0 days.

(21) Appl. No.: 10/019,367

(22) PCT Filed: Apr. 5, 2000

(86) PCT No.: PCT/CA00/00520

§ 371 (c)(1),
(2), (4) Date: Apr. 30, 2002

(87) PCT Pub. No.: WO00/67850

PCT Pub. Date: Nov. 16, 2000

Related U.S. Application Data

(63) Continuation of application No. 09/306,017, filed on May 6, 1999, now Pat. No. 6,189,625.

(51) Int. Cl.
*B05B 7/30* (2006.01)

(52) U.S. Cl. ..... 239/353; 239/369; 239/372; 239/337; 169/30; 169/74; 169/88; 169/89; 222/402.15

(58) Field of Classification Search ..... 169/30, 169/74, 85, 88, 89; 239/302, 337, 369, 370, 239/371, 372, 375, 527, 414, 419, 433, 583, 239/355, 368, 364–366, 311, 434; 222/402.1, 222/402.15, 545, 399; 137/597, 625.4, 625.48

See application file for complete search history.

(56) References Cited

U.S. PATENT DOCUMENTS

| | | | | | |
|---|---|---|---|---|---|
| 689,107 | A | * | 12/1901 | Mitchell | 239/371 |
| 1,263,291 | A | | 4/1918 | Schultz | |
| 1,377,009 | A | * | 5/1921 | Dunn | 239/366 |
| 1,797,584 | A | * | 3/1931 | O'Neill | 239/311 |
| 2,040,302 | A | * | 5/1936 | Fortier | 239/372 |
| 2,107,313 | A | | 2/1938 | Urquhart | |
| 2,109,966 | A | * | 3/1938 | Breitmann | 169/74 |
| 2,755,865 | A | | 7/1956 | Jacobs | |
| 2,832,425 | A | | 4/1958 | Jacobs | |
| 2,959,358 | A | * | 11/1960 | Vork | 239/414 |
| 3,199,600 | A | | 8/1965 | Jacobs | |
| 3,658,254 | A | * | 4/1972 | Lee | 239/337 |
| 3,705,689 | A | * | 12/1972 | Lee | 239/369 |
| 4,417,674 | A | | 11/1983 | Giuffredi | |
| 4,505,336 | A | | 3/1985 | Thevis et al. | |
| 4,815,541 | A | | 3/1989 | Arrington | |
| 4,862,968 | A | | 9/1989 | Woodman | |
| 5,611,485 | A | * | 3/1997 | Davis | 239/364 |
| 5,676,210 | A | | 10/1997 | Sundholm | |
| 5,799,735 | A | | 9/1998 | Sundholm | |

(Continued)

FOREIGN PATENT DOCUMENTS

| | | |
|---|---|---|
| CA | 2162235 | 6/1996 |

(Continued)

*Primary Examiner*—Steven J. Ganey
(74) *Attorney, Agent, or Firm*—McFadden, Fincham

(57) ABSTRACT

A liquid mist fire extinguisher, comprising a container for holding a gas and a liquid under pressure. The extinguisher has valve assembly at the upper end of the container, a valve for simultaneously releasing said gas and said liquid separately from the container, and a hose for feeding said gas and said liquid separately through a nozzle. The nozzle assembly includes means for feeding said gas and said liquid separately through a mixing chamber, and exiting orifices in an end surface of said nozzle assembly for issue of mixed gas and liquid in a fine mist.

7 Claims, 7 Drawing Sheets

U.S. PATENT DOCUMENTS

| | | | | |
|---|---|---|---|---|
| 5,845,716 | A | 12/1998 | Birk | |
| 6,189,625 | B1 * | 2/2001 | Hopkins | 169/88 |

FOREIGN PATENT DOCUMENTS

| | | | |
|---|---|---|---|
| CA | 2235946 | | 5/1997 |
| CA | 2237014 | | 5/1997 |
| CA | 2225073 | | 6/1998 |
| DE | 2747588 | A1 | 10/1979 |
| EP | 0 314 354 | A1 | 3/1989 |
| WO | 19724339 | A1 | 5/1998 |

* cited by examiner

LIQUID MIST FIRE EXTINGUISHER

This application is a continuation application Ser. No. 09/306,017, filed May 6, 1999, now U.S. Pat. No. 6,189,625.

FIELD OF INVENTION

This invention relates to a liquid mist fire extinguisher and more particularly a low pressure water atomizing fire extinguisher.

BACKGROUND TO THE INVENTION

Fires are classified as A, B, C or D as follows: Class A: ordinary combustibles; Class B: flammable liquids; Class C: electrical fires and Class D: flammable metals. Fire extinguishers are listed in Canada and the United States by ULC and UL respectively according to their effectiveness in suppressing the fires of the various classes. A standard extinguisher with an A:B:C rating for example, is effective in suppressing A, B and C class fires.

To achieve an A:B:C rating, extinguishers to date have used either dry chemicals or halon. The use of dry chemicals results in a messy and sometimes toxic cleanup. Halon is a clean alternative but has been banned by the Montreal Protocol on Substances that Deplete the Ozone Layer.

Water has also been used but prior art water extinguishers have not achieved an A:B:C rating. The standard water extinguisher for example discharges a solid stream of water from a pressurized canister and has a limited Class 2A rating.

Another type of known water extinguisher discharges a spray of water droplets and utilizes the same amount of water as the standard extinguisher. This extinguisher typically operates at about 100 psi. While this water extinguisher has been rated A:C, it does not generate the fine atomized mist required for a class B rating.

WO 97 02863 to Richter, Joachim discloses a fire extinguisher and a specially designed spray nozzle for producing a jet of extinguishing agent, wherein the extinguisher comprises a pair of containers adapted to store carbon dioxide gas and extinguishing water, whereby upon mixing inside the spray nozzle the carbon dioxide gas causes the water droplets to freeze, allowing for improved throwing ranges.

It is therefore an aspect of the present invention to provide an extinguisher in which water and air are stored together and are released simultaneously and separately to produce a fine liquid mist, capable of class A:B:C rating.

SUMMARY OF THE INVENTION

In accordance with the present invention, there is provided an apparatus for producing a fine liquid mist, comprising a container (10) for holding a gas and liquid under pressure, valve means for releasing the gas and the liquid from the container, a nozzle, feed means operatively connecting the nozzle and the container, and a mixing chamber in the nozzle, the mixing chamber having outlet orifices for emission of the liquid mist, the outlet orifices being at a discharge end of the mixing chamber characterized in that the container having acutation means for simultaneously actuating first and second valve means, the actuation means comprising a single actuation lever for simultaneously opening and closing both of the valve means; the valve means comprising a first valve for controlling and regulating the flow of liquid from a container to a first supply means and a second valve for controlling and regulating the flow of gas from the container to a second supply means, wherein simultaneous release of the liquid and the gas is achieved when the single actuating lever is displaced whereby movement of each of the first and second valves occurs, and wherein the mixing chamber includes two separate inlets at one end, a first inlet for injection of the liquid radially into the mixing chamber and a second inlet for injection of the gas axially into the mixing chamber for atomization of the liquid.

In another aspect of the present invention, there is provided a release assembly for simultaneously releasing a gas and a liquid separately from a pressurized container containing the gas and liquid and to permit feeding the liquid and the gas as individual, separate fluid streams from the container and to and through the valve, characterized in that the release assembly is a single actuating means connected to first and second valves for simultaneously actuating the valves, the first valve for controlling and regulating the flow of liquid from a container to a first supply means, the second valve for controlling and regulating the flow of gas from the container to a second supply means, and whereby movement of the single actuating means effects opening a closing of the valves to effect control and regulation of flow of the liquid and the gas.

In a further embodiment of the present invention, there is provided a liquid mist fire extinguisher, comprising a container for holding a gas and a liquid under pressure, a valve assembly at an upper end of the container for releasing the gas and the liquid from the container, a hose and a nozzle assembly, characterized in that the extinguisher has a single actuating means for simultaneous release of the liquid and the gas by simultaneously actuating first and second valve means, the actuating means controlling spaced apart first and second valves, and wherein the valve means simultaneously releases the gas and the liquid separately from the container, the first valve means controlling and regulating the flow of liquid from a container and the second valve controlling and regulating the flow of gas from the container.

In an apparatus for dispensing a gas and a liquid from a container holding the gas and liquid, the improvement wherein the container includes a body having separate outlets for dispensing each of the gas and the liquid from the container, the outlet for the gas being in communication with the gas in the container and the outlet for the liquid being in communication with the liquid in the container, first valve means in the body associated with the outlet for dispensing the liquid and second valve means being associated with the outlet for dispensing the gas, means to open together each of the first and second valve means, wherein the body includes a conduit in communication with liquid in the container, the body having a chamber in communication with the conduit, the chamber having a conduit in communication with the liquid outlet, and wherein the separate outlets for the gas and the liquid are adapted to discharge separate gas and liquid streams from the body upon actuation of the means to open the first and second valve means.

DETAILED DESCRIPTION OF THE PREFERRED EMBODIMENT

Figure 1:
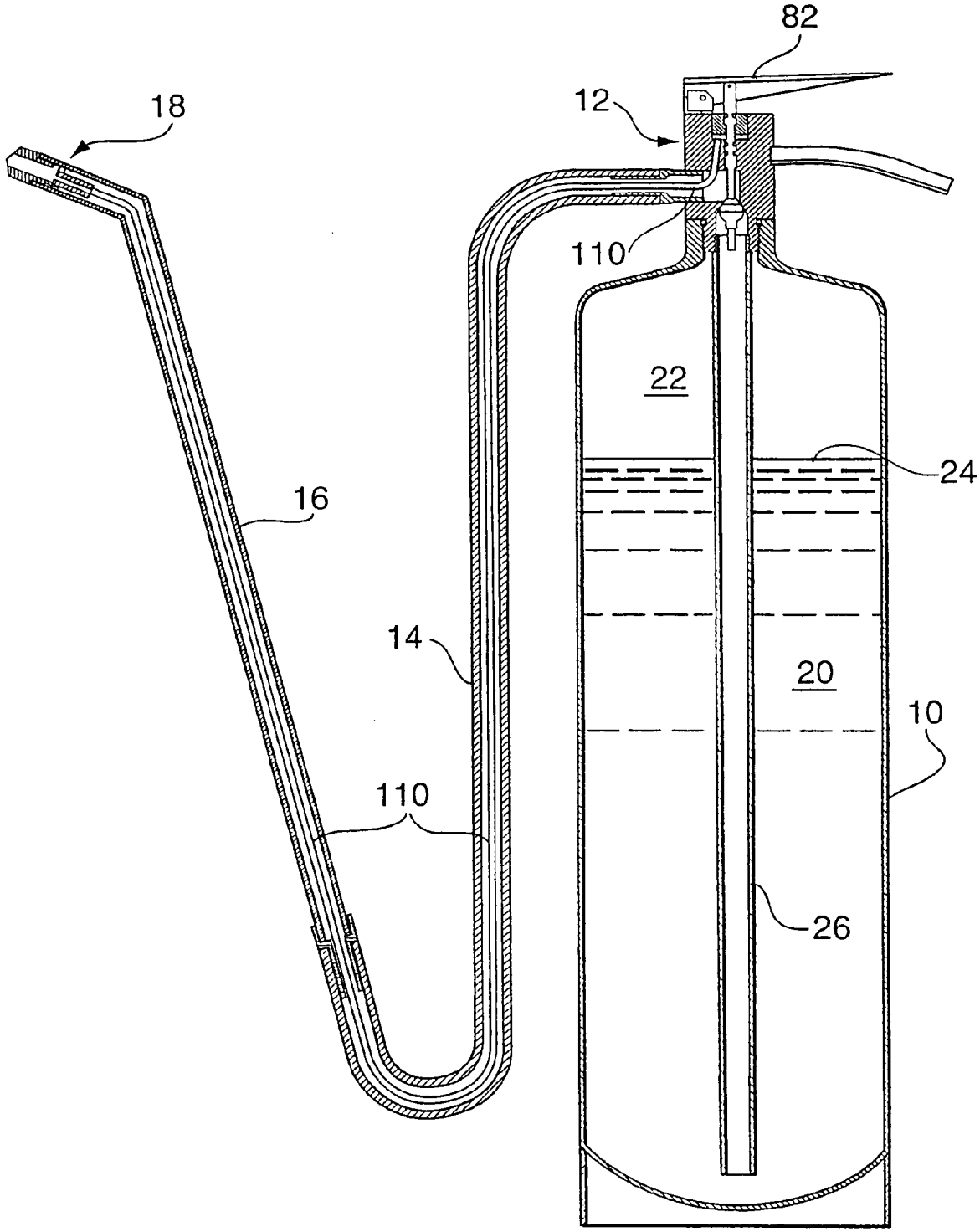
FIG. 1 is a cross-section of a fire extinguisher according to the present invention.

The drawings illustrate a fire extinguisher assembly having an A, B and C rating comprising a pressure container 10 of, for example, an approximately 12 L capacity having at its upper end a valve structure 12, and flexible hose 14 with a relatively ridged wand portion 16, and a nozzle assembly 18 at the end of the wand 16. The valve structure 12 closes the upper end of the container which, in use contains a liquid, for example, water, at its lower portion 20 and a pressurizing gas, for example, air at its upper portion 22, the gas/liquid in the phase shown at 24. A tube 26 extends down and from the valve structure 12 towards the bottom of container, finishing a short distance above the bottom. The tube is connected at its upper end to the valve structure 12.

Figure 2:
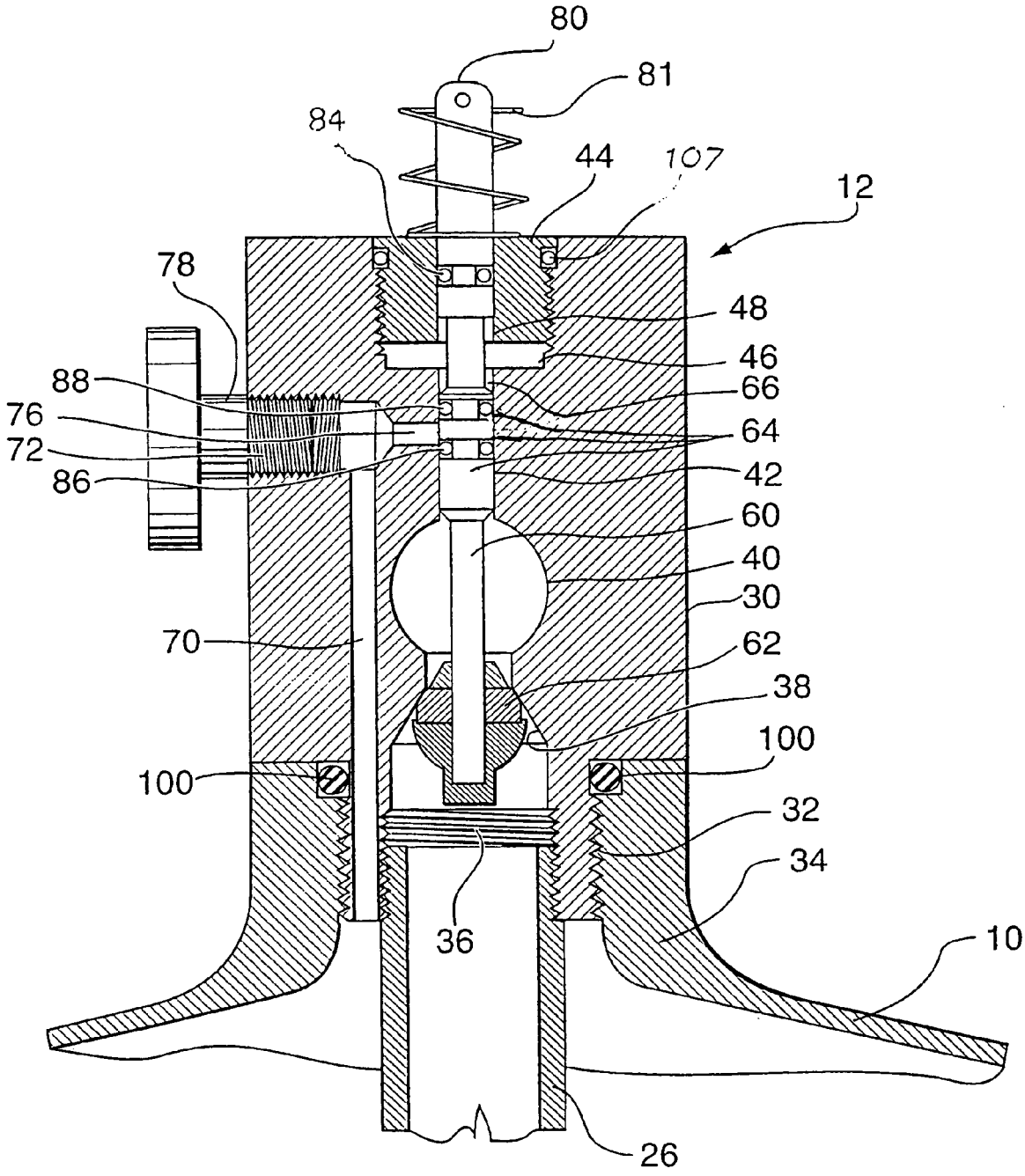
FIG. 2 is a cross-section of the valve structure at the top of the extinguisher of FIG. 1, to a larger scale, and at right angles to that of FIG. 1; with valve closed.
Figure 3:
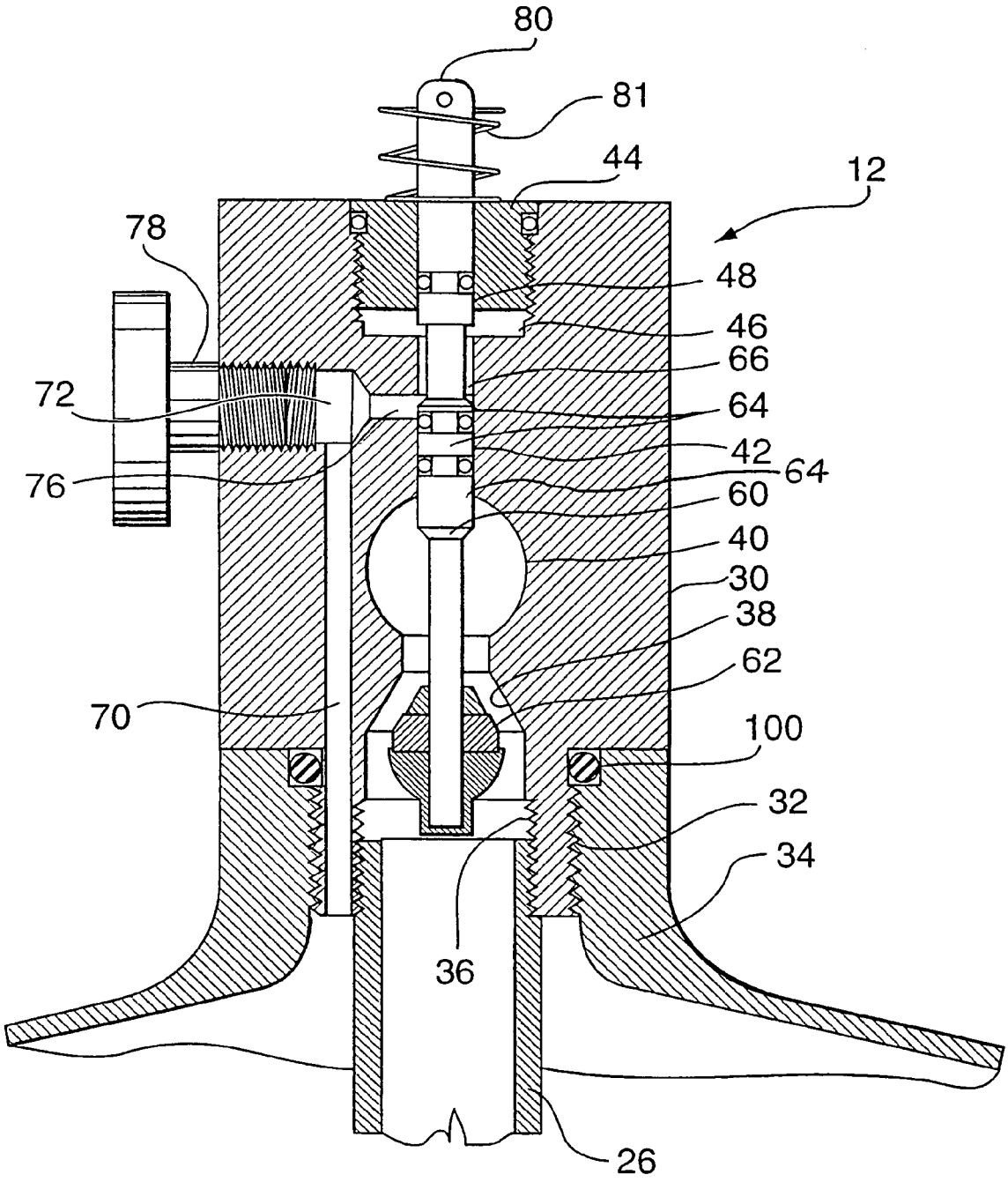
FIG. 3 is a cross section similar to that of FIG. 2, with valve open.

FIGS. 2 and 3 show specifically the valve structure indicated by reference numeral 12. It comprises a main body 30, which is attached by a fitted threaded connection 32 to a neck portion 34 at the upper part of container 10. The body 30 has a central longitudinal extending bore, having a varying dimension along its length. At its lower end 36, the bore is enlarged and receives the upper end of the tube 26, conveniently provided with a threaded connection. The bore tapers inwardly to form a valve seat 38 of a first valve. The bore enlarges, at 40, to form a fluid passage, described later in connection with FIG. 4. Above the enlargement 40, the bore decreases in size to form an elongate tubular seating at 42. Above the tubular seating 42, the bore is enlarged and a plug 44 is inserted to close off the bore, and also to form a chamber which serves as a transfer passage 46, again described in more detail with respect to FIG. 4. The plug 44 has a central bore 48 and extending through the bore is an elongate valve member or stem 60. At its lower end, the valve stem 60 has a tapered valve member or seal 62, which cooperates with tapered valve seat 38. At an intermediate position, there is provided a second valve comprised of an extended valve portion 64 which cooperates with the tubular seating 42.

The first valve comprised of valve member or seal 62 and valve seat 38 acts to control flow of liquid from container. The second valve formed of the upper end of the valve portion 64 acts with the upper end of seating 42 to control flow of gas from the container 10.

A further bore 70 extends up through the body 30 and connects to a radial bore 72 extending to the central bore to form a port 76, between the enlargement 40 and the passage 46. The outer end of the radial bore 72 is closed by a plug 78 which can be used to provide a connection to a pressure gauge. Considering the valve portion 64, a reduced diameter portion 66 on the valve member 60 connects with the passageway 46 only, in a closed position, as in FIG. 2, and connects passageway 46 with port 76, in an open position, as in FIG. 3.

The upper end 80 of the valve member 60 extends beyond the plug 44. A lever 82 (see FIG. 1) is pivotally mounted on the end of the stem 60 and extends over the outer end 80. A compression spring 81 is mounted on the outer end 80 of the valve member 60 to bias the valve member to a closed position. Pressure by the lever 82 on the outer end 80 of the valve member 60 will open both valves simultaneously. Various seals are provided for the valve member 60. An O-ring 84 is provided between the passage 46 and the upper end surface of the body 30, in the example of the plug 44, to prevent leakage from the top end or upper surface of the body 30. O-rings 86 and 88 are spaced apart to prevent leakage from port 76 to the passage 46 and enlargement 40 in the valve closed position, and to prevent leakage from the port 76 to the enlargement 40 in the valve open position. O-rings 100 and 107 can be provided in a conventional manner, such as to seal threaded connections 32 and the threaded connection between the plug 44 and the upper end of the body 30.

Figure 4:
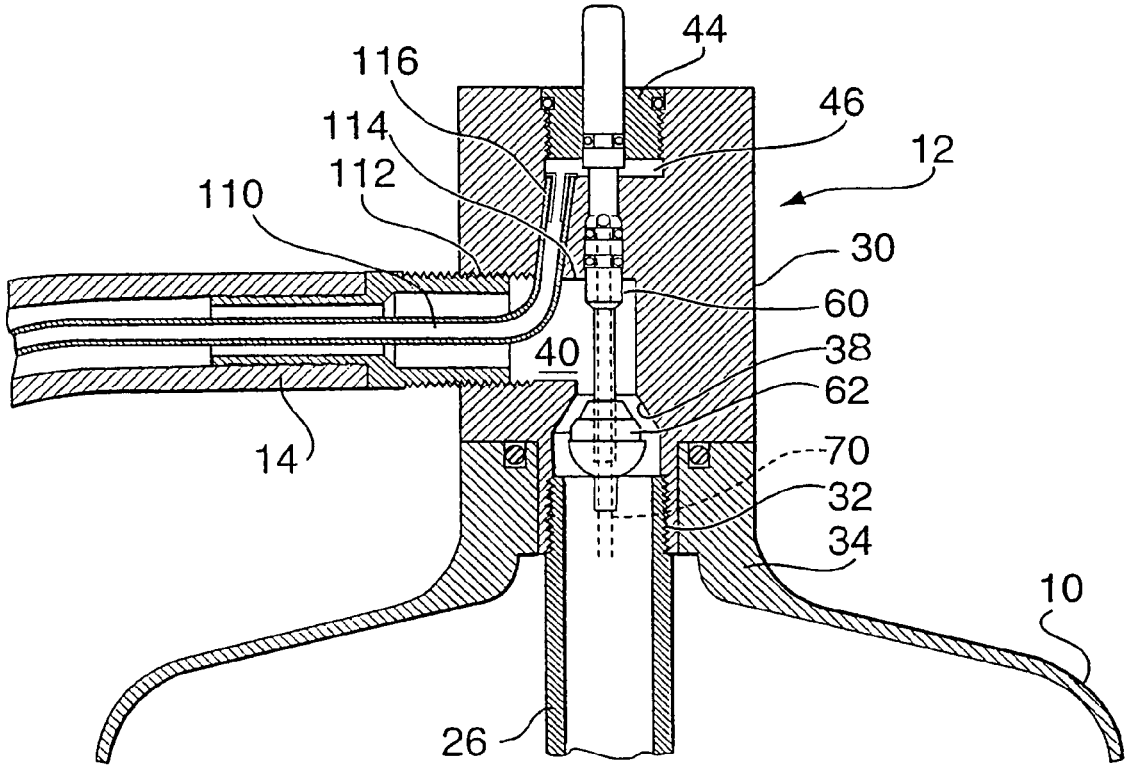
FIG. 4 is a cross section of the valve structure, on the axis of the cross section of FIG. 1.

FIG. 4 illustrates the attachment of the flexible hose 14 to the valve body 30, with connections to the enlargement 40, and also connection of a flexible tube 110, inside the hose 14 to the passage 46. The hose 14 is connected to the body 30 via a threaded connection 112 in a bore 114 connecting to the enlargement 40. The tube 110 extends up through a bore 116 in the top part of the body 30 to connect to the passage 46. As seen in FIG. 1, the tube 110 extends through the hose 14 and wand 16 to a nozzle assembly 18.

When the valves are closed, neither the liquid nor gas can flow from the container 10 to the nozzle assembly 18. Pushing down on the lever 82 opens the valves to a position as seen in FIG. 3. Liquid escapes up past the lower end of the valve member 60 into the enlargement 40 and up through bore 114 and connection 112 into the hose 14. Simultaneously, air escapes through bores 70 and 76, recess 66, passage 46 and then through the tube 110 to nozzle 18.

Figures 5, 6:
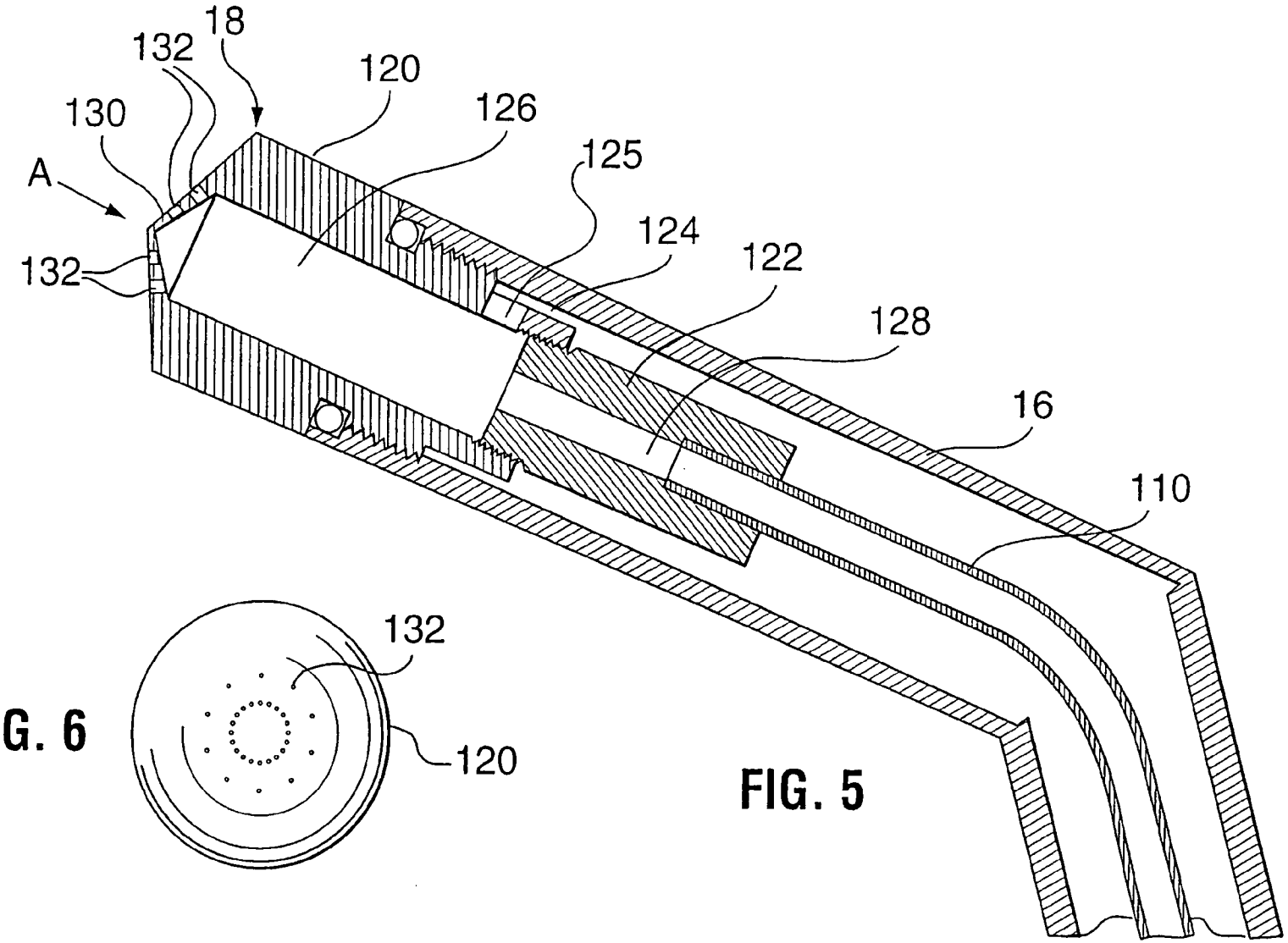
FIG. 5 is a longitudinal cross section through the nozzle.
FIG. 6 is an end view on the end of the nozzle member, in the direction of arrow A.

One form of nozzle assembly 18 is illustrated in FIG. 5. This assembly has a nozzle member 120 attached to the end of the wand 16 and an internal intermediate support member 122 to which the tube 110 is connected. The member 122 includes an orifice or bore 128 formed internally of the member 122, and can be, e.g., 0.75–1.5 mm in diameter.

The member 122 is connected to the nozzle member 120 forming an axial hollow or mixing chamber 126. A passage 124 provides access, via a port 125, to a mixing chamber 126 for the liquid in the wand 16. Port 125, can be, e.g., 2–3.5 mm in diameter. Liquid enters the mixing chamber 126 through the port 125 at right angles to the longitudinal axis of the nozzle 18. Gas flows through bore 128 of the member 122 into the mixing chamber 126 and interreacts with the liquid, for effective atomization of the liquid.

The nozzle member 120 is circular in cross section, and has a closed end with a number of orifices 132. One arrangement is seen in FIG. 6. The nozzle member 120, at one end of the nozzle assembly 18 has, when seen in cross section (FIG. 5) with respect to the longitudinal axis, an angled face 130, the angle being preferably in the range of 60° to 75°.

The gas enters the mixing chamber in a longitudinal direction and combines with the jet of liquid that is entering the mixing chamber at port 125. Thus, this will produce a gas/liquid mixture. The mixture exits the chamber 126 through the orifices 132, resulting in further expansion and further atomization of the liquid. The orifice pattern 132 combined with the amount of atomization and end face angles produces the described mist pattern.

To charge the container 10, about 6 L of liquid, for example water is placed in the container. The gas, for example air, is fed into the upper part of the container 10 through the wand 16 by removing the nozzle 120 and replacing it with an air valve (not shown). The gas source means is connected to the air valve, the valves are opened and air is fed into the container 10. After pressurization, the nozzle is replaced. Pressurization in this manner minimizes later tampering. As an alternative, the gas is fed through bore 72 by removing plug 78. As a further alternative, a pressure gauge can be permanently mounted at the bore 72, and this can be provided with a T-shaped valved connection having an air valve for connection of a pressurized source of gas. The gas is generally pressurized initially to a maximum pressure of about 175 pounds per square inch.

Figure 7:
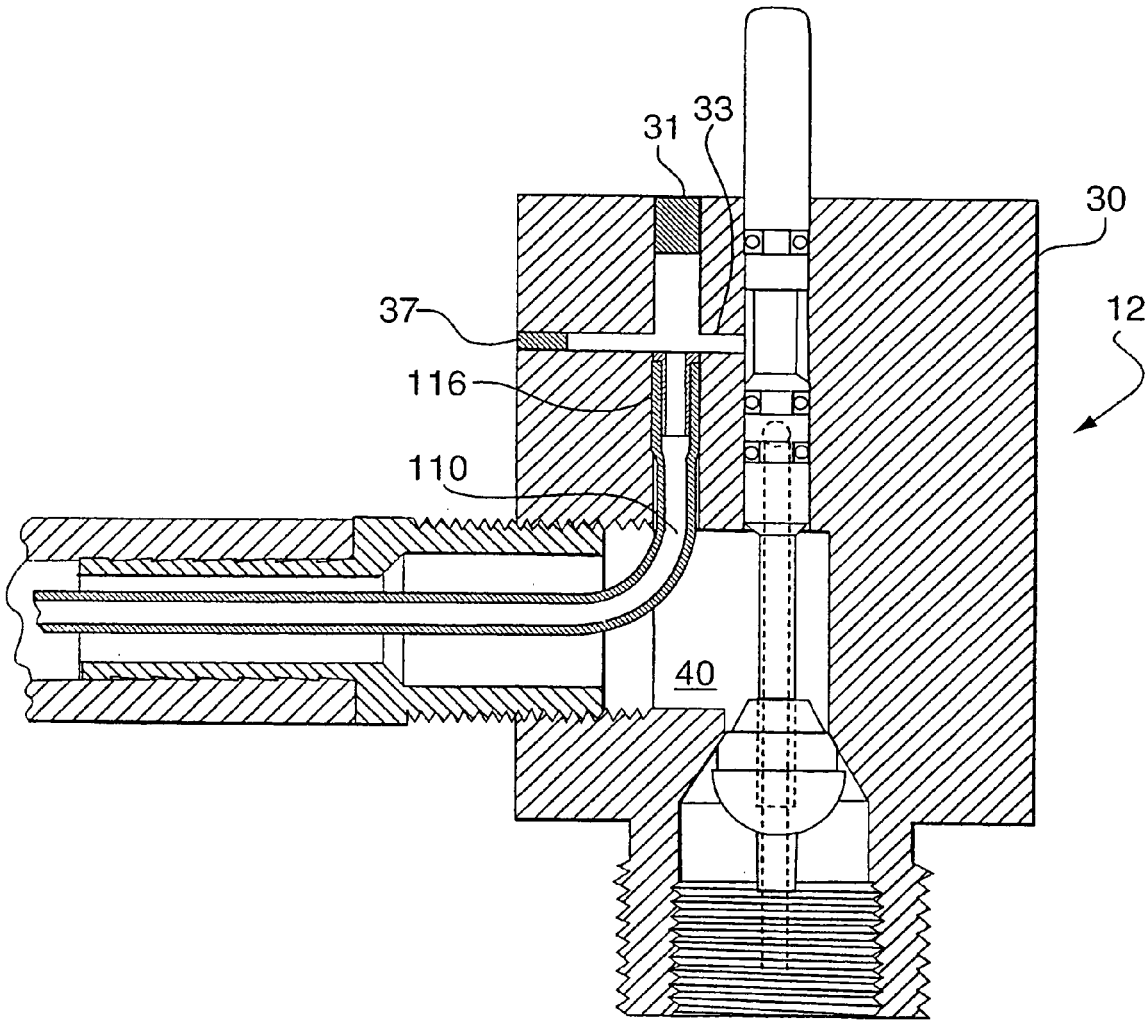
FIG. 7 is a cross-section of another embodiment of the valve structure of the present invention, on the axis of the cross-section FIG. 1.

FIG. 7 illustrates an alternate embodiment of the valve structure 12. The central longitudinal extending bore above enlargement 40 is not enlarged, eliminating the need for a plug such as plug 44 (see FIG. 4) to close off the bore. The bore 116 extends through the top of the valve body 30. The top of the bore 116 is closed by a plug 31. A second bore 33 serves as a transfer passage in place of the chamber 46 (see FIG. 4), and is closed by plug 37. The valve structure 12 is otherwise the same as the previous embodiment including the tube 110 which extends up through bore 116.

Figure 8:
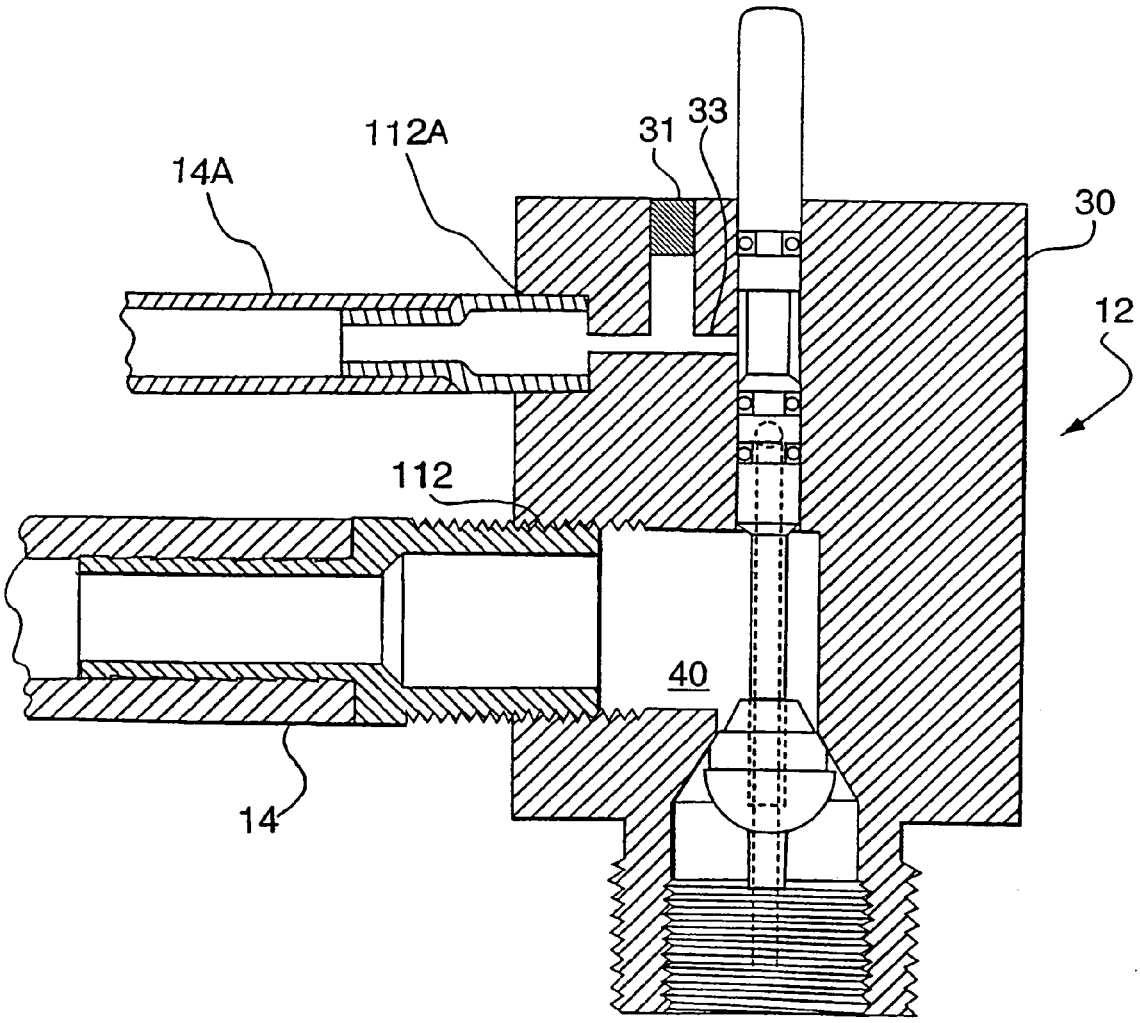
FIG. 8 is a cross section of another embodiment of the valve structure of the present invention, on the axis of the cross section of FIG. 1.

FIG. 8 illustrates a further alternative embodiment of the valve structure 12. The central longitudinal extending bore above enlargement 40 is not enlarged eliminating the need for a plug such as plug 44 (see FIG. 4) to close off the bore. Also eliminated is bore 116 (see FIG. 7). A bore 33 serves as a transfer passage in place of the transfer passage or chamber 46 (see FIG. 4), and is connected through a connection 112A to a flexible hose 14A. As with previous embodiments of the present invention, when the valves are closed, neither the liquid nor gas can flow from the container 10. In use, with similar components described above, pushing down on a lever opens the valves whereby liquid escapes up past the lower end of the valve member into the enlargement and up through the connection and into the hose. Simultaneously, air escapes through suitable bores or the like, through a transfer passage and then through the connection 112A to the hose 14A.

A carrying handle can be attached through the valve structure 12 as seen in FIG. 1. The container is shaped so that such can normally stand upright on a surface.

Although embodiments of the invention have been described above, it is not limited thereto and it will be apparent to those skilled in the art that numerous modifications form part of the present invention insofar as they do not depart from the spirit, nature and scope of the claimed and described invention.

What is claimed is:

1. In an apparatus for dispensing a gas and a liquid from a container holding said gas and liquid, the improvement wherein the container includes a body having separate outlets for dispensing each of said gas and said liquid from said container, said outlet for said gas being in communication with the gas in the container and the outlet for the liquid being in communication with the liquid in the container, first valve means in said body associated with said outlet for dispensing said liquid and second valve means being associated with said outlet for dispensing said gas, means to open together each of said first and second valve means, wherein said body includes a conduit in communication with liquid in said container, said body having a chamber in communication with said conduit, said chamber having a conduit in communication with said liquid outlet, and wherein said separate outlets for said gas and said liquid are adapted to discharge separate gas and liquid streams from said body upon actuation of said means to open said first and second valve means.

2. The apparatus of claim 1, wherein said body includes a transfer passage between said outlet for said gas and said second valve means for dispensing said gas.

3. The apparatus of claim 2, wherein said transfer passage includes a bore perpendicular to said transfer passage, one end of said bore being connected to said transfer passage and the other end of said bore being in communication with the exterior of said body, and plug means for closing said bore at said other end.

4. The apparatus of claim 1, wherein said outlets for dispensing said gas and said liquid are each connected to separate exterior conduits to convey separate streams of said liquid and said gas.

5. The apparatus as claimed in claim 1, said first and said second valve means comprising an extended stem portion which is movable to open and close said outlets to dispense said gas and said liquid as separate streams.

6. The apparatus according to claim 1, wherein said first and second valve means are connected to each other in operative association to simultaneously release said gas and said liquid as separate streams from said container.

7. The apparatus according to claim 1, further including an elongate valve member, wherein said first valve means is formed at one end of said valve member, said second valve means formed at a position intermediate the other end of said valve member and said first valve means, said means for opening each of said first and second valve means positioned at the other end of said valve member.

* * * * *